United States Patent [19]

Lyden

[11] Patent Number: 4,616,265

[45] Date of Patent: Oct. 7, 1986

[54] DEFLECTION YOKE ASSEMBLY AND MOUNTING ARRANGEMENT

[75] Inventor: Thomas B. Lyden, Schaumburg, Ill.

[73] Assignee: RCA Corporation, Princeton, N.J.

[21] Appl. No.: 684,603

[22] Filed: Dec. 21, 1984

[51] Int. Cl.[4] ..... H01J 9/00

[52] U.S. Cl. ..... 358/248; 156/291; 156/315; 156/330; 445/23

[58] Field of Search ..... 445/36, 23, 34; 222/148; 239/112; 156/315, 291, 330; 264/328.6; 425/132

[56] References Cited

U.S. PATENT DOCUMENTS

| | | | |
|---|---|---|---|
| 2,847,340 | 8/1958 | Joosten | 156/291 |
| 3,512,233 | 5/1970 | Mancini | 445/36 |
| 3,566,321 | 2/1971 | Brown, Jr. | 335/210 |
| 3,747,773 | 7/1973 | Jackson | 156/291 X |
| 3,770,547 | 11/1973 | Kelsey | 156/314 |
| 4,016,363 | 4/1977 | Deal et al. | 156/315 |
| 4,051,286 | 9/1977 | Abbott | 156/295 |
| 4,119,110 | 10/1978 | Stone | 222/148 |
| 4,314,963 | 2/1982 | Boden et al. | 264/328.6 |
| 4,383,547 | 5/1983 | Lorenz et al. | 222/148 |
| 4,523,696 | 6/1983 | Commette | 222/148 |

FOREIGN PATENT DOCUMENTS

| | | | |
|---|---|---|---|
| 3023 | 9/1982 | PCT Int'l Appl. | 228/148 |
| 1156546 | 6/1969 | United Kingdom . | |

*Primary Examiner*—Kenneth J. Ramsey

*Attorney, Agent, or Firm*—Paul J. Rasmussen; Joseph Laks; Scott J. Stevens

[57] ABSTRACT

A deflection yoke is mounted to a cathode ray tube by the use of two adhesives having different hardening rates. A first adhesive is applied between the yoke and the tube by a dispensing machine in a sufficient quantity to temporarily hold the yoke on the tube. A second adhesive having a hardening rate slower than the first adhesive is applied between the yoke and tube by the dispensing machine. The second adhesive purges the first adhesive from the dispensing machine. The quantities of the first and second adhesives are required to permanently mount the yoke to the tube. This arrangement may be used to assemble the yoke itself, as well as assembling the yoke and mounting it to a tube in the same operation.

31 Claims, 5 Drawing Figures

DEFLECTION YOKE ASSEMBLY AND MOUNTING ARRANGEMENT

This invention relates to attachment systems for deflection yokes and, in particular, to attachment systems incorporating the use of adhesives.

The construction of a deflection yoke and its placement on a color cathode ray tube of a video display apparatus, such as a television receiver or a computer monitor, is subject to critical specifications and tolerances in order to meet the performance standards of the video display apparatus. The alignment of the deflection coils must be accurately controlled during assembly of the yoke. The placement of the deflection yoke itself is determined by adjusting the position of the yoke to optimize several performance parameters, including color purity and convergence. Once the desired yoke position is attained, the yoke must be attached to the cathode ray tube in a manner that maintains the position of the yoke after the adjusting fixture is removed.

A typical yoke-to-cathode ray tube attachment arrangement includes a screw-tightenable clamp at the back of the yoke to fix the longitudinal position on the cathode ray tube neck. The front of the yoke is then adjusted to optimize, for example, electron beam convergence at the edges of the cathode ray tube display screen. The front of the deflection yoke is then fixed with respect to the cathode ray tube by inserting several rubber wedges between the yoke and the tube.

Due to the previously described individual adjustment, the position of a deflection yoke with respect to a cathode ray tube may be different from yoke to yoke. The exact placement of the wedges for all yoke-tube assemblies cannot be determined from a fixed reference point, so that automatic insertion of wedges is difficult and costly to implement, A practical solution therefore requires manual placement of wedges which is time consuming and expensive. Additionally, the wedges may provide insufficient support for the deflection yoke, allowing shifting of the yoke position to occur when the adjustment fixture is disengaged, thereby resulting in degraded performance of the video display apparatus.

The use of adhesives to attach the deflection yoke to the cathode ray tube permits easier use of automation equipment. Adhesives are difficult to handle, however, as fast-set adhesives may plug the dispensing equipment if production delays are encountered and slow-set adhesives increase the time required to process each yoke-tube assembly.

The deflection yoke is ordinarily assembled by aligning the horizontal and vertical coils with respect to each other and to the magnetically permeable deflection yoke core in order to optimize yoke performance with reference to a standard cathode ray tube. Compensation is provided for any distortion introduced by the tube so that the deflection yoke is effectively assembled with reference to an error-and distortion-free cathode ray tube.

The actual cathode ray tube on which the assembled deflection yoke is ultimately mounted may not be error or distortion-free, however. The horizontal and vertical coils of the deflection yoke may not be properly aligned for optimum performance on the actual cathode ray tube that is to be used with the deflection yoke. Although it is therefore desireable to align and assemble a particular deflection yoke to the particular tube on which it is to be used, this procedure is difficult and costly to implement.

In accordance with the present invention, a deflection yoke is mounted to a cathode ray tube of a video display apparatus by means of a first adhesive having a first volume and a first hardening rate. The first adhesive is disposed between the deflection yoke and the cathode ray tube. A second adhesive having a second volume and a second hardening rate is also located between the deflection yoke and the cathode ray tube. The second hardening rate is substantially slower than the first hardening rate. The sum of the first and second volumes is sufficient to hold the deflection yoke in position during normal operation of the video display apparatus.

In accordance with another aspect of the present invention, the first and second adhesives may be applied between the horizontal and vertical deflection coils of the yoke in order to fix the relative position of the yoke coils during assembly of the deflection yoke.

In the accompanying drawing, FIG. 1 is a block diagram of a video display system adjustment and assembly arrangement;

Figure 1:
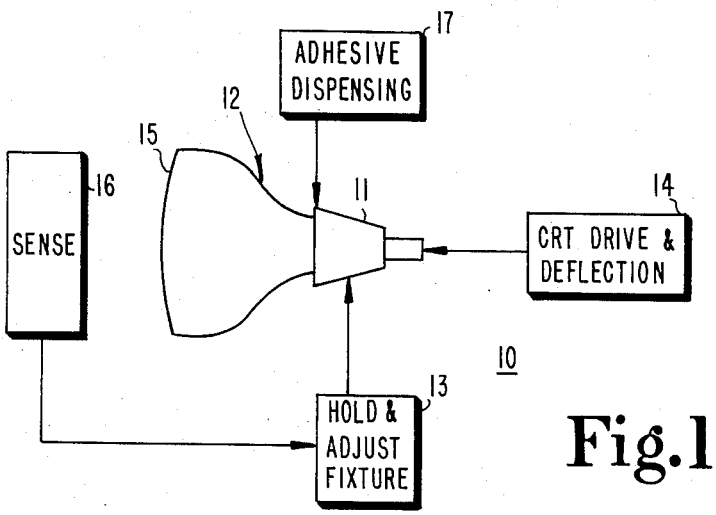

Referring to FIG. 1, there is shown a video display system adjustment and assembly arrangement 10 in which a deflection yoke 11 is disposed on the neck of a cathode ray tube 12. The position of deflection yoke 11 relative to cathode ray tube 12 is controlled by a holding and adjustment fixture 13. Fixture 13 may be of a type that positions a previously assembled deflection yoke onto a production cathode ray tube to form a completed yoke-tube assembly, or a type that positions the individual coils and core of a deflection yoke with respect to a "standard" cathode ray tube having predetermined, compensated errors in order to form as assembled deflection yoke that can later be positioned on a production tube. Fixture 13 may also be of a type, illustratively shown in U.S. Pat. No. 4,360,839, issued Nov. 23, 1982, in the name of Ragland et al., and entitled DEFLECTION YOKE ADJUSTMENT APPARATUS, which independently adjusts the position of the horizontal and vertical deflection coils with respect to each other and to a production cathode ray tube to form a yoke-tube assembly.

Cathode ray tube 12 is energized by cathode ray tube drive and deflection circuitry 14, which illustratively energizes and deflects one or more of the cathode ray tube electron beams to form a raster on the cathode ray tube display screen 15 that aids in adjustment and proper positioning of deflection yoke 11. Sensing circuitry 16, which may, for example, incorporate a video camera or a plurality of photodiodes, determines the amount of electron beam landing error of a given type, e.g., misconvergence at a given display screen 15 location. The output of sensing circuitry 16 is applied to holding and adjustment fixture 13 which adjusts the position of the deflection yoke 11 in order to decrease the magnitude of the errors determined by sensing circuitry 16.

In accordance with an aspect of the present invention, video display system adjustment and assembly arrangement 10 incorporates an adhesive dispensing apparatus 17. Depending on the application of video display system adjustment and assembly arrangement 10, adhesive dispensing apparatus 17 may be utilized to affix the coils of deflection yoke 11 with respect to each other, to attach yoke 11 to cathode ray tube 12, or in combination, affix the coils of yoke 11 and attach yoke 11 to cathode ray tube 12.

Figure 2:
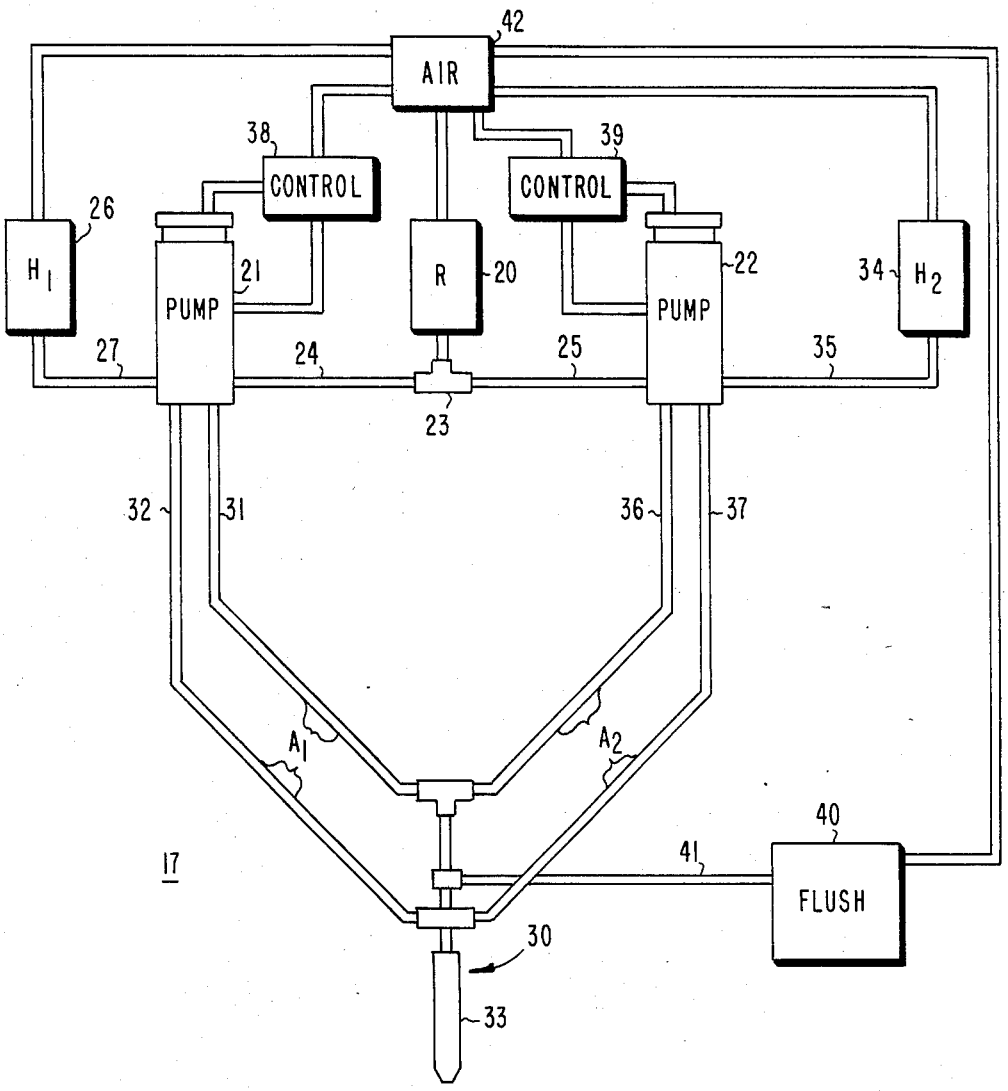
FIG. 2 is a block and schematic diagram of an adhesive dispensing system in accordance with an aspect of the present invention.

Referring to FIG. 2, the construction and operation of adhesive dispensing apparatus 17 will be explained. Adhesive dispensing apparatus 17 is adapted to dispense two adhesives having different hardening properties. Each of the adhesives comprises a multi-component adhesive system, which may be of the type, for example, of adhesives identified as epoxies, polyurethanes, polyesters, or acrylics. One example of a polyurethane adhesive having selectable hardening properties is identified as Pliogrip, manufactured by Ashland Chemical Co., Ashland, Ky. Other multi-component compounds may also be used.

In the embodiment shown in FIG. 2, the adhesive compounds comprise two-component systems of which the first component is a resin material R, located in container 20. Resin R is supplied to pumps 21 and 22 via a connector 23 and supply lines 24 and 25, respectively. Pumps 21 and 22 each provide a metered output quantity for the components of a two component adhesive and are manufactured, for example, by Fluid Kinetics Inc. of Fairfield, Ohio.

The other component of the adhesive provided by pump 21 is a hardener designated $H_1$ and supplied to pump 21 from container 26 along supply line 27. Resin R and hardener $H_1$ are applied to an adhesive mixing and dispensing head 30 along supply lines 31 and 32, respectively. Mixing and dispensing head 30, which incorporates various connectors and supply lines and a mixing and dispensing nozzle 33, combines resin R with hardener $H_1$ to form the desired adhesive which may be applied to predetermined locations of the deflection yoke 11 or the cathode ray tube 12. Mixing and dispensing nozzle 33 may, for example, be of a static type manufactured by Chemineer, Inc. of Dayton, Ohio. The adhesive resulting from the combination of resin R and hardener $H_1$, designated adhesive $A_1$, sets or hardens in a relatively short length of time, less than one minute and preferably of the order of 10–30 seconds, which is a rate that permits rapid processing of deflection yokes or tube-yoke combinations by video display system adjustment and assembly arrangement 10.

Although the use of fast-set adhesives may result in processing or throughput advantages, unforseen production delays may cause fast-set adhesives to undesireably harden within adhesive mixing and dispensing head 30 and particularly within dispensing nozzle 33 prior to dispensing, thereby interrupting the operation of adhesive dispensing apparatus 17 and necessitating the repair or replacement of adhesive dispensing head 30. In accordance with an aspect of the present invention, adhesive dispensing apparatus 17 prevents undesirable adhesive hardening in the mixing and dispensing head 30 by providing a second adhesive designated $A_2$ from pump 22. Adhesive $A_2$ comprises resin R and a hardener $H_2$ supplied to pump 22 from a container 34 via a supply line 35. Adhesive $A_2$ desireably sets or hardens in a time less that one hour and preferably of the order of 30 minutes, which is long compared to the time durin which adhesive $A_1$ hardens. The resin R and hardener $H_2$ of adhesive $A_2$ are provided to adhesive mixing and dispensing head 30 via supply lines 36 and 37, respectively.

The use of dual hardening rate adhesives with a single dispensing nozzle is described as follows. Holding and adjustment fixture 13 positions the deflection yoke 11 on the yoke coils in their desired position. Adhesive dispensing apparatus 17 is operated to place dispensing head 30 at a proper location to dispense adhesive. An initial quantity of fast-set adhesive $A_1$ is dispensed at predetermined locations on the deflection yoke or cathode ray tube. The quantity of adhesive $A_1$ is sufficient to fix the position of the deflection yoke coils and/or to attach the yoke to the cathode ray tube in a temporary manner. For reasons described below, the quantity of adhesive $A_1$ is not sufficient, however, to maintain the yoke or yoke coils in position with the strength needed to meet normal handling and operating requirements.

After the desired quantity of adhesive $A_1$ is applied, a quantity of adhesive $A_2$ is then applied to the deflection yoke or cathode ray tube. The passing of adhesive $A_2$ through adhesive mixing and dispensing head 30 forces out or purges substantially all of adhesive $A_1$ that remained in mixing and dispensing head 30. Adhesive $A_2$ sets or hardens at a slow enough rate that minor production delays or interruptions do not present a risk of adhesive hardening in mixing and dispensing head 30. If extended delays or long periods of non-use occur, a flushing system 40 is provided, which applies an adhesive solvent to mixing and dispensing head 30 via supply line 41 that removes the residual adhesive, therby preventing clogging of mixing and dispensing head 30. Operation of pumps 21 and 22 and the transportation of resin R, hardeners $H_1$ and $H_2$, and the purging solvent are effected by the use of compressed air provided by an air compressor 42. Control apparatus 38 and 39 apply air to pumps 21 and 22, respectively, during the appropriate pump cycles.

The quantity of adhesive $A_2$ is sufficient, when combined with the quantity of adhesive $A_1$ and hardened, to impart sufficient strength to the deflection yoke and/or the cathode ray tube-yoke combination to meet the necessary testing and operating requirements. As previously described the quantity of adhesive $A_1$ used is sufficient to maintain the yoke or yoke coils in the desired position until adhesive $A_2$ sets or hardens.

By utilizing two adhesives having different hardening rates, a rapid processing rate may be achieved without the need for purging the adhesive dispensing system with solvent between each deflection yoke. This results in more efficient use of time and since both adhesives are necessary for permanent assembly of the yoke or permanent attachment of the yoke to the cathode ray tube does not unnecessarily waste adhesive or solvent.

Resin R and hardeners $H_1$ and $H_2$ may be made to have different colors to provide visual feedback to an equipment operator or inspector. For example, different colors for the hardeners $H_1$ and $H_2$, red and blue, for example, provide a positive indication that the fast-set adhesive has been effectively purged from the mixing and dispensing head 30. A visual check that the proper quantities of adhesive have been applied may be made. It is therefore possible to identify adhesives $A_1$ and $A_2$ by their color. This may be very useful as the adhesives may not be easily distinguishable once they have hardened. During adhesive purges, a mixing of adhesives $A_1$ and $A_2$ may occur, thereby forming a small quantity of transistional adhesive. If the resin R is also made a different color, white, for example, a positive indication that efficient mixing of resin and hardener has occurred is provided.

Figure 3:
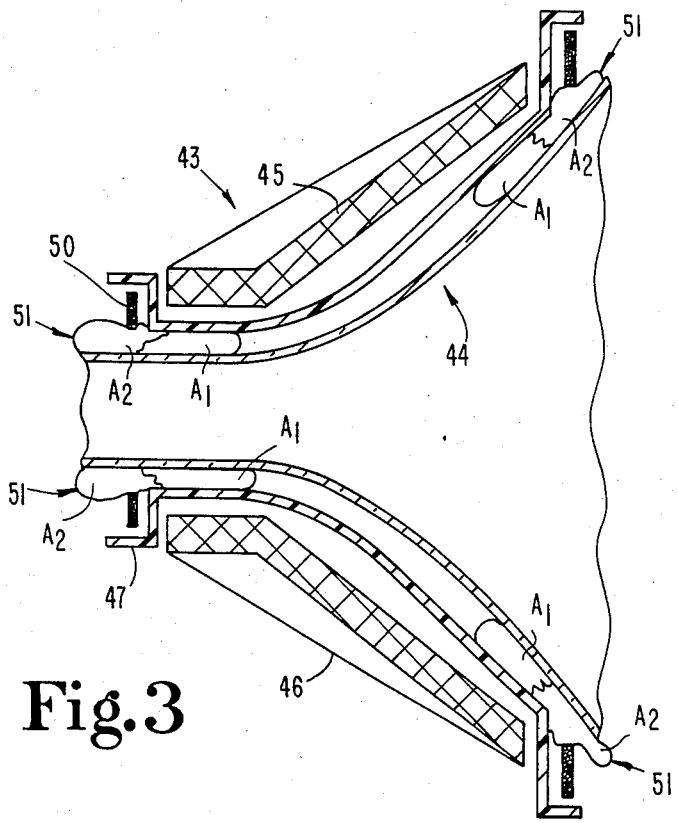
FIGS. 3 and 4 are side cross-sectional views of a portion of a deflection yoke and kinescope assembly.

FIG. 3 illustrates in cross section a deflection yoke 43 in place on a cathode ray tube 44. Yoke 43 comprises a magnetically permeable core 45 on which are toroidally wound the vertical deflection coils 46. Yoke 43 also incorporates a plastic insulator 47 and saddle-type horizontal deflection coils 50 of which only the end turns are shown. Adhesive 51 is illustratively shown in position at various locations in order to attach yoke 43 to tube 44. As can be seen, adhesive 51 is made up of a quantity of fast-set adhesive $A_1$ and slow-set adhesive $A_2$. The location of the adhesive and quantities of adhesives $A_1$ and $A_2$ are shown for illustrative purposes only. The actual location and quantities of the adhesives needed would be determined by testing or experimentation.

Adhesive dispensing apparatus 17, along with the rest of video display system adjustment and assembly arrangement 10, may be controlled automatically by way of a computer, for example. Adhesive dispensing apparatus 17 may also be positioned by a robot, for example, so that adhesive may be applied to any number of desired locations. For example, once the desired position of the deflection yoke is attained, the position may be stored in the equipment memory. The yoke may then be moved out of position to allow desireable placement of the adhesive. The yoke is then returned to its proper position and held by the holding and adjustment fixture 13 for the short time needed until fast-set adhesive $A_1$ hardens. Removal of fixture 13 will not result in movement of deflection yoke 11, as may occur with the use of the previously described rubber positioning wedges.

Figure 4:
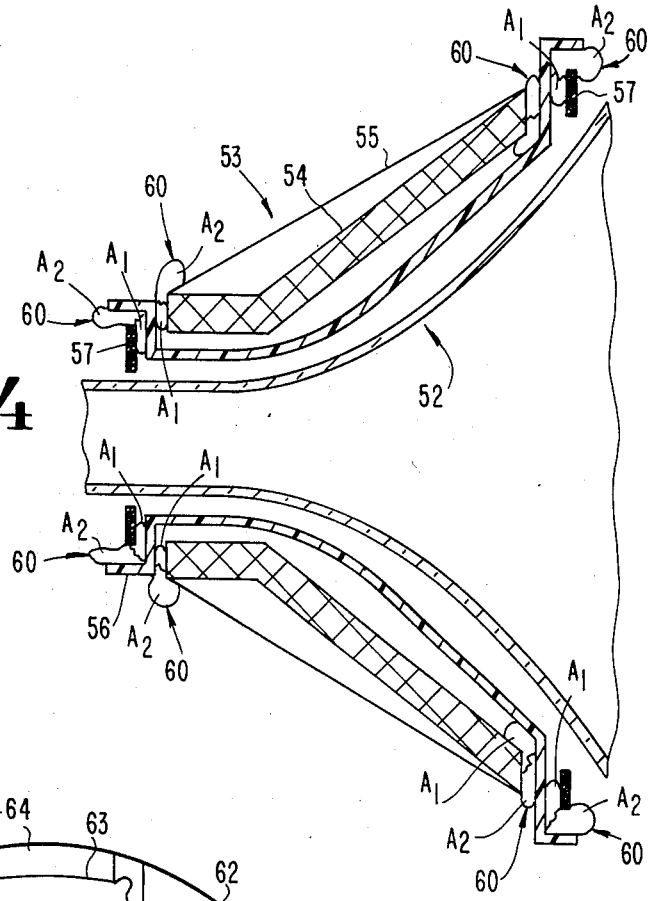

The yoke itself may be assembled in a similar manner with respect to a "standard" cathode ray tube to be later attached to production tubes, as previously described. As shown in FIG. 4, a cathode ray tube 52 having known or compensatable errors is selected as a standard tube to which the deflection yokes are adjusted. A yoke 53 comprising a core 54, toroidal vertical deflection coils 55, insulator 56 and horizontal saddle coils 57 is placed on tube 52. The horizontal and vertical deflection coils are adjusted with respect to each other to optimize the electron beam landing errors on the cathode ray tube display screen. The relative position of the coils is then fixed by the application of adhesive 60 at various locations, which is similar to adhesive 51, having fast hardening adhesive $A_1$ and slow hardening adhesive $A_2$.

In a similar manner, a deflection yoke may be assembled, by adjusting the relative position of the deflection coils, and attached to a production cathode ray tube in the same operation, thereby matching the characteristic of the deflection yoke to the characteristics of the cathode ray tube as closely as possible.

Video display system adjustment and assembly arrangement 10, incorporating adhesive dispensing apparatus 17, may therefore be used to efficiently assemble deflection yokes with respect to a "standard" cathode ray tube, to attach preassembled yokes to production tubes, or most desirably, assemble and attach yokes to production tubes. This arrangement permits the most effective alignment and adjustment of the yoke and yoke coils to optimize the greatest number of display errors.

Figure 5:
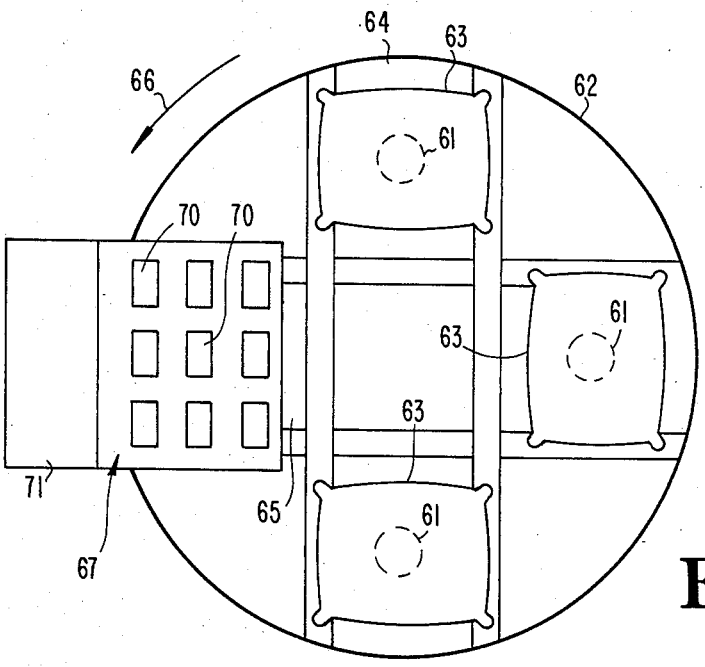
FIG. 5 is a block and schematic diagram of another inventive embodiment of a deflection yoke adjustment and mounting system.

FIG. 5 shows an illustrative embodiment of a portion of a video display system adjustment and assembly arrangement in which deflection yokes 61 (shown in phantom) are assembled and attached to production cathode ray tubes. A turntable 62 receives cathode ray tubes 63. A robot (not shown) may perform the function of loading and unloading tubes 63 onto and from turntable 62 at a turntable location 64. The turntable 62 rotates in a direction shown by arrow 66. A fixed arrangement at turntable location 65 incorporates a fixture (not shown) which places a yoke 61 onto tube 63 and holds it in place. The yoke is adjusted in response to an output from an error sensing circuit 67 which may comprise a video camera or a plurality of photodiodes 70. An adhesive dispensing apparatus 71 of the type previously described applies an adhesive to yoke 61 and/or to tube 63 to assemble yoke 61 and attach it to tube 63. The yoke and tube combination is then rotated through other turntable locations to allow the adhesive to harden before the yoke is removed from the turntable. Other arrangements for adjusting and attaching deflection yokes using adhesive dispensing apparatus embodying the invention are, of course, possible and the example shown in FIG. 5 is merely illustrative.

What is claimed is:

1. A method for attaching a deflection yoke to a cathode ray tube comprising the steps of:

placing said deflection yoke in a desired position on said cathode ray tube via a positioning means;

dispensing a first quantity of adhesive having a first hardening rate between said deflection yoke and said cathode ray tube via a dispensing means, sufficient to temporarily maintain said deflection yoke on said cathode ray tube;

dispensing a second quantity of adhesive, having a second hardening rate slower than said first hardening rate, between said deflection yoke and said cathode ray tube via said dispensing means, said adhesive having said second hardening rate purging said adhesive having said first hardening rate from said dispensing means, said first and second quantities of adhesive being sufficient to permanently maintain said deflection yoke on said cathode ray tube; and maintaining said deflection yoke on said cathode ray tube via said positioning means until said adhesive having said first hardening rate hardens.

2. The method defined in claim 1, wherein said positioning means incorporates position sensing feedback means for optimizing the position of said deflection yoke with respect to said cathode ray tube.

3. The method defined in claim 1, wherein said adhesive having said first hardening rate is of a different color than said adhesive having said second hardening rate in order to provide visual feedback with respect to the purging of said dispensing means.

4. The method defined in claim 1, wherein said first hardening rate is of the order of 10–30 seconds.

5. The method defined in claim 1, wherein said second hardening rate is of the order of 30 minutes.

6. The method defined in claim 1, wherein said adhesive having said first hardening rate and said adhesive having said second hardening rate each comprises first and second adhesive components, said first and second adhesive components having different colors to provide visual feedback with respect to the degree of mixing of said first and second adhesive components.

7. The method defined in claim 1, wherein said adhesive having said first hardening rate and said adhesive having said second hardening rate comprise adhesives of the epoxy type.

8. The method defined in claim 1, wherein said adhesive having said first hardening rate and said adhesive having said second hardening rate comprise adhesives of the polyurethane type.

9. A method for assembling a deflection yoke by affixing the relative position of the horizontal and vertical deflection coils of said deflection yoke comprising the steps of:

placing said horizontal and vertical deflection coils in a desired position with respect to each other via a positioning means;

dispensing a first quantity of adhesive having a first hardening rate between said horizontal and vertical deflection coils, via a dispensing means, sufficient to temporarily maintain the relative position of said horizontal and vertical deflection coils;

dispensing a second quantity of adhesive, having a second hardening rate slower than said first hardening rate, between said horizontal and vertical deflection coils via said dispensing means, said adhesive having said second hardening rate purging said adhesive having said first hardening rate from said dispensing means, said first and second quantities of adhesive being sufficient to permanently maintain the relative position of said horizontal and vertical deflection coils; and maintaining the relative position of said horizontal and vertical deflection coils via said positioning means until said adhesive having said first hardening rate hardens.

10. The method defined in claim 9, wherein said positioning means incorporates position sensing feedback means for optimizing the relative position of said horizontal and vertical deflection coils of said deflection yoke.

11. The method defined in claim 9, wherein said adhesive having said first hardening rate is of a different color than said adhesive having said second hardening rate in order to provide visual feedback with respect to the purging of said dispensing means.

12. The method defined in claim 9, wherein said first hardening rate is of the order of 10–30 seconds.

13. The method defined in claim 9, wherein said second hardening rate is of the order of 30 minutes.

14. The method defined in claim 9, wherein said adhesive having said first hardening rate and said adhesive having said second hardening rate each comprises first and second adhesive components, said first and second adhesive components having different colors to provide visual feedback with respect to the degree of mixing of said first and second adhesive components.

15. The method defined in claim 9, wherein said adhesive having said first hardening rate and said adhesive having said second hardening rate comprise adhesives of the epoxy type.

16. The method defined in claim 9, wherein said adhesive having said first hardening rate and said adhesive having said second hardening rate comprise adhesives of the polyurethane type.

17. A method for assembling a deflection yoke to a cathode ray tube comprising the steps of:

placing the horizontal and vertical deflection coils of said deflection yoke in a desired position with respect to each other and to said cathode ray tube via a positioning means;

dispensing a first quantity of adhesive, having a first hardening rate, between said horizontal and vertical deflection coils and between said deflection yoke and said cathode ray tube, via a dispensing means, sufficient to temporarily maintain the relative position of said horizontal and vertical deflection coils and to temporarily maintain said deflection yoke on said cathode ray tube;

dispensing a second quantity of adhesive, having a second hardening rate slower than said first hardening rate, between said horizontal and vertical deflection coils, and between said deflection yoke and said cathode ray tube via said dispensing means, said adhesive having said second hardening rate purging said adhesive having said first hardening rate from said dispensing means, said first and second quantities of adhesive being sufficient to permanently maintain the relative position of said horizontal and vertical deflection coils and to permanently maintain said deflection yoke on said cathode ray tube; and maintaining the relative position of said horizontal and vertical deflection coils and maintaining said deflection yoke on said cathode ray tube via said positioning means until said adhesive having said first hardening rate hardens.

18. The method defined in claim 17, wherein said positioning means incorporates position sensing feedback means for optimizing the relative position of said horizontal and vertical deflection coils and for optimizing the position of said deflection yoke with respect to said cathode ray tube.

19. The method defined in claim 17, wherein said adhesive having said first hardening rate is of a different color than said adhesive having said second hardening rate in order to provide visual feedback with respect to the purging of said dispensing means.

20. The method defined in claim 17, wherein said first hardening rate is of the order of 10–30 seconds.

21. The method defined in claim 17, wherein said second hardening rate is of the order of 30 minutes.

22. The arrahgement defined in claim 17, wherein said adhesive having said first hardening rate and said adhesive having said second hardening rate each comprises first and second adhesive components, said first and second adhesive components having different colors to provide visual feedback with respect to the degree of mixing of said first and second adhesive components.

23. The method defined in claim 17, wherein said adhesive having said first hardening rate and said adhesive having said second hardening rate comprise adhesives of the epoxy type.

24. The method defined in claim 17, wherein said adhesive having said first hardening rate and said adhesive having said second hardening rate comprise adhesives of the polyurethane type.

25. An assembly comprising:

a cathode ray tube;

a deflection yoke located on said cathode ray tube;

a first quantity of a first multi-component adhesive having a first hardening rate disposed between said deflection yoke and said cathode ray tube; and a second quantity of a second multi-component adhesive having a second hardening rate slower than said first hardening rate also disposed between said deflection yoke and said cathode ray tube, the combination of said first and second quantities of adhesive being sufficient to permanently mount said deflection yoke to said cathode ray tube.

26. The assembly defined in claim 25, wherein said first hardening rate is of the order of 10–30 seconds.

27. The method defined in claim 25, wherein said second hardening rate is of the order of 30 minutes.

28. The assembly defined in claim 25, wherein said adhesive having said first hardening rate and said adhesive having said second hardening rate each comprises first and second adhesive components, said first and second adhesive components having different colors to provide visual feedback with respect to the degree of mixing of said first and second adhesive components.

29. The assembly defined in claim 25, wherein said adhesive having said first hardening rate and said adhesive having said second hardening rate comprise adhesives of the epoxy type.

30. The assembly defined in claim 29, wherein said adhesive having said first hardening rate has a different color than said adhesive having said second hardening rate.

31. The assembly defined in claim 25, wherein said adhesive having said first hardening rate and said adhesive having said second hardening rate comprise adhesives of the polyurethane type.

* * * * *